US010658766B2

(12) United States Patent
Herrmann et al.

(10) Patent No.: US 10,658,766 B2
(45) Date of Patent: May 19, 2020

(54) SPRING TERMINAL FOR A CONDUCTOR

(71) Applicant: Weidmüller Interface GmbH & Co. KG, Detmold (DE)

(72) Inventors: Michael Herrmann, Detmold (DE); Constantin Classen, Detmold (DE); Karlo Stjepanovic, Bielefeld (DE); Stephan Fehling, Lage (DE); Walter Hanning, Detmold (DE); Jens Oesterhaus, Detmold (DE); Marco Waldhoff, Steinheim (DE); Herbert Fricke, Detmold (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 16/305,953

(22) PCT Filed: May 26, 2017

(86) PCT No.: PCT/EP2017/062749
§ 371 (c)(1),
(2) Date: Nov. 30, 2018

(87) PCT Pub. No.: WO2017/207429
PCT Pub. Date: Dec. 7, 2017

(65) Prior Publication Data

US 2019/0319374 A1 Oct. 17, 2019

(30) Foreign Application Priority Data

May 30, 2016 (DE) ..... 20 2016 102 850 U
Oct. 18, 2016 (DE) ..... 20 2016 105 824 U
(Continued)

(51) Int. Cl.
*H01R 4/48* (2006.01)

(52) U.S. Cl.
CPC ..... *H01R 4/4836* (2013.01); *H01R 4/4827* (2013.01)

(58) Field of Classification Search
CPC ... H01R 4/4818; H01R 4/4827; H01R 4/4836
(Continued)

(56) References Cited

U.S. PATENT DOCUMENTS 7,115,001 B1 * 10/2006 Brockman ..... H01R 4/4827 439/828
7,997,915 B2 8/2011 Pueschner et al.
8,113,858 B1 * 2/2012 Chiang ..... H01R 13/701 439/188
(Continued)

FOREIGN PATENT DOCUMENTS

DE 102004001202 A1 7/2004
DE 102008039232 A1 2/2010
(Continued)

*Primary Examiner* — Gary F Paumen
(74) *Attorney, Agent, or Firm* — Laubscher & Laubscher, P.C.

(57) ABSTRACT

A direct clamp terminal for connecting a conductor in the form of a flexible stranded conductor includes a housing with a chamber and an insertion conduit for inserting the conductor into the chamber. A bus bar or a clamping cage is provided in the housing and a clamping spring is located in the chamber and acts as a compression spring for securing the electrical conductor to the bus bar or the clamping cage in the area of a clamping point. The clamping spring has a clamping limb that can be pivoted about a pivoting axis and that can be shifted from a detent mode in which it is locked in a detent position into a clamping mode in which it is released from the detent mode and presses the electrical conductor against the bus bar or the clamping cage. The clamping limb can be released from the detent mode using two different shifting devices.

25 Claims, 19 Drawing Sheets

(30) Foreign Application Priority Data

Dec. 12, 2016 (WO) ..... PCT/EP2016/080558
Mar. 22, 2017 (DE) ..... 20 2017 101 670 U

(58) Field of Classification Search
USPC ..... 439/441
See application file for complete search history.

(56) References Cited

U.S. PATENT DOCUMENTS 8,251,738 B2 * 8/2012 Heckert ..... H01R 4/4836 439/441
8,444,443 B2 * 5/2013 Schafmeister ..... H01R 4/4836 439/441
8,579,651 B2 * 11/2013 Hanning ..... H01R 4/4836 439/441
8,794,994 B2 * 8/2014 Kollmann ..... H01R 4/4836 439/441
2002/0155750 A1 * 10/2002 Beege ..... H01R 4/4836 439/441
2004/0248457 A1 * 12/2004 Walter ..... H01R 4/4836 439/441
2006/0128206 A1 * 6/2006 Oesterhaus ..... H01R 4/4836 439/441
2007/0099479 A1 * 5/2007 Holterhoff ..... H01R 4/4836 439/441
2010/0081316 A1 * 4/2010 Eppe ..... H01H 1/5844 439/441

FOREIGN PATENT DOCUMENTS

EP 0899818 A2 3/1999
EP 2768079 A1 8/2014

* cited by examiner a)

b)

SPRING TERMINAL FOR A CONDUCTOR

This application is a § 371 of PCT/EP2017/062749 filed May 26, 2017. PCT/EP2017/062749 claims priority of DE 20 2016 102 850.7 filed May 30, 2016, DE 20 2016 105 824.4 filed Oct. 18, 2016, PCT/EP2016/080558 filed Dec. 12, 2016 and DE 20 2017 101 670.6 filed Mar. 22, 2017. The entire contents of these applications are incorporated herein by reference.

BACKGROUND OF THE INVENTION

The present invention relates to a spring terminal.

Such spring terminals designed like direct clamp push-in terminals with a clamping spring designed as a pressure spring which presses a conductor against a bus bar and are known in many embodiments. They differ in particular due to their usage, for example, as a function of the required ability of the bus bar to carry current, of the spring force of the clamping spring and/or of their installation conditions, in particular of their structural size. A simple assembly and an economical manufacture are requirements which are constantly placed on such a terminal.

U.S. Pat. No. 7,997,915 B2 discloses a wire end casing having a direct clamp terminal arranged on one end for securely connecting an electrical conductor. The direct clamp terminal includes a current-conducting clamping cage for electrically contacting the electrical conductor and includes a spring for securing the electrical conductor. The spring includes a pivotable clamping limb which is positioned on a holding device when an electrical conductor is not introduced into the direct clamp terminal so that a free space for the electrical conductor is maintained and the conductor can be introduced into the clamping cage. During the introduction into the direct clamp terminal, the holding device is shifted in such a manner that the clamping limb detaches and is pivoted. The pivoted clamping limb presses the electrical conductor onto the clamping cage.

EP 2 768 079 A1 discloses a further development of this direct clamp terminal in which a detent mode can be reestablished with an actuating element and a pressure element after a release of the locked clamping limb by the conductor.

While conventional spring terminals operate satisfactorily, there is a need for a spring terminal, in particular an attachable spring terminal, in particular for stranded conductors having a small cross section which improves the clamping operation of the terminal.

SUMMARY OF THE INVENTION

A spring terminal, in particular a direct clamp terminal, is created for the connection of a conductor which can be constructed as a flexible stranded conductor. The spring terminal includes a housing with a chamber and with an insertion conduit for inserting the conductor into the chamber, a bus bar, a clamping spring arranged in the chamber and functioning as a pressure spring for fixing the electrical conductor to the bus bar in the area of a clamping position. The clamping spring includes a clamping limb which can pivot about a pivot axis in a pivoting direction and which can be moved from a detent mode in which it is locked in a locked position into a clamping state in which it is released from the detent mode and presses the electrical conductor against the bus bar, wherein the clamping limb can be loosened out of the detent mode by two different adjusting devices.

The release of the open position or of the locked position of the clamping limb is possible in two different ways. This is advantageous since when the actuation of one adjustment device does not lead in the individual case to the release of the locked position of the clamping spring or of the clamping limb, the other adjustment device can be used in order to release the clamping spring or its clamping limb out of the locked position.

This is not known from EP 2 768 079 A1 because in it the detent mode is not released with the pressure element but only reestablished.

Furthermore, the problem is solved by a spring terminal in particular a direct clamp terminal, for connecting a conductor which can be constructed as a flexible stranded conductor which includes a housing with a chamber and an insertion conduit for inserting the conductor into, the chamber The spring terminal further includes a bus bar and/or a clamping cage and a clamping spring arranged in the chamber and acting as a pressure spring for fixing the electrical conductor on the bus bar and/or on the clamping cage in the area of a clamping position The clamping spring includes a clamping limb which can pivot about a pivot axis and can be moved from a detent mode in which it is locked in a locked position into a clamping state in which it is released from the detent mode and presses the electrical conductor against the bus bar or the clamping cage. The detent mode is not produced by locking an element to a free terminal edge of the clamping limb. The detent mode can be released by introducing the conductor in the direction of the conductor introduction into the housing.

It is advantageous that the detent mode is not produced by locking an element on a free terminal edge of the clamping limb and that nevertheless the detent mode can be readily released by introducing the conductor in the direction of the introduction of the conductor into the housing because relatively high forces on the terminal edge of the clamping limb are or would be required for loosening the locking position. In addition, wear can occur on the terminal edge as a result of locking. This problem is avoided in this manner. In addition, defined friction conditions are produced outside of the terminal edge—in particular during a locking by pressure onto the clamping limb and locking a latch on the housing. Accordingly, it is also preferred that the detent mode is produced by pressure on the clamping limb in the direction of the introduction of the conductor, for example, with the aid of an actuating element acting on the clamping limb, in particular a latch which can be locked on the housing in a locked position in which it holds the clamping limb in the open position by pressure in the direction of the introduction of the conductor. In this way, only relatively low forces and in addition relatively precisely defined forces are required for releasing the clamping limb with the conductor out of the locked position. The invention also utilizes this advantageous effect for releasing the locked position with the conductor itself in that the latch is coupled to a movable release element which cooperates with the clamping limb and which can be moved by pressure of the conductor in order to also release the latch out of its locked position in this manner.

It is advantageous if the sole or the first of the two adjusting devices includes a movable release element on which the end of the conductor to be contacted during the release of, the conductor acts and with which the clamping limb of the clamping spring can be directly or indirectly released from the detent mode—in the latter instance via at least one interposed element. In the first instance—with direct action—it is also conceivable, for example, that the release element is formed in one piece with the latch.

Furthermore, it is advantageous if the second one of the two adjustment devices includes an actuating element for moving the clamping limb because it is advantageous if the actuating element itself can be locked in the detent mode jointly with the clamping limb of the clamping spring and can be released directly from the detent mode, as a result of which even the clamping limb of the clamping spring can also be released out of the detent mode.

The release of the open position and of the locked position of the clamping limb is possible in two different ways. Thus, the release of the locking position of the clamping limb can take place on the one hand with the aid of the conductor and on the other hand with the aid of the actuating element. This is advantageous since in such a manner even if the conductor is constructed as a very thin multi-stranded conductor with which only a very slight force can be exerted on the release element, the latch itself can be directly used in order to release the clamping spring and its clamping limb out of the locked position.

According to another embodiment which can be readily realized constructively and functions in a reliable manner, the actuating element is a latch for moving the clamping limb which can be shifted in an actuating conduit of the housing in the direction of insertion and can move in a limited fashion vertically to the direction of insertion and which can be locked in the housing on a locking edge in the detent mode.

This can be readily achieved because the latch includes a lateral catch edge which can be locked in the detent mode by moving vertically to the insertion direction behind the locking edge of the housing and can be released by an opposite movement out of the detent mode.

According to a further embodiment, the latch is moved into the locking position during manual moving in the insertion direction after having passed the locking edge by the spring power of the clamping spring and the latch can be released by moving in the opposite direction by a manually actuatable actuating tool such as a screwdriver.

Furthermore, the latch can be kept relatively short in the insertion direction since the latch has a recess for receiving an actuating tool which is dimensioned in such a manner that a movement of the latch can be realized in the insertion direction and also vertically to the insertion direction with the actuating tool.

An alternative compact construction can be economically realized where the release element is designed as a tilting lever pivotably supported in the housing. It is advantageous if the tilting lever includes two lever arms of which one lever arm is designed to be pivoted with the conductor and the other lever arm is designed to act on the latch in order to release it from the detent mode.

The spring terminal is not only suitable for un-stranded conductors but also especially for stranded conductors. This is because the stranded conductor can be shifted back-and-forth in the free space of the chamber in the housing without the strands having to be spliced in the detent mode. The bus bar is formed of a material which has good electrical conductivity, for example, copper or a copper alloy. A spring steel is suitable for manufacturing the clamping spring.

BRIEF DESCRIPTION OF THE FIGURES

The invention will be described in detail in the following description with reference to the accompany drawings, in which.

DETAILED DESCRIPTION

Figure 4:
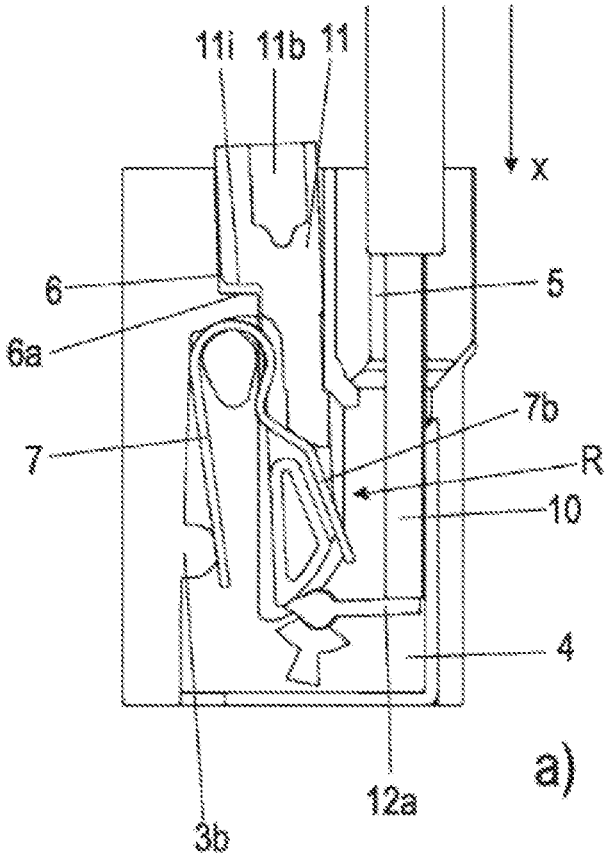
FIG. 4*a* is a sectional view of a spring terminal similar to FIGS. 1*a* and 2*a* with a conductor during introduction of the conductor into the spring terminal, wherein the clamping limb is still in the detent mode.
FIG. 4*b* is a detailed sectional view of a portion of the spring terminal shown in FIG. 4*a;*
FIG. 4*c* is a perspective sectional view of the spring terminal from FIG. 4*a* with an electrical conductor introduced into the spring terminal and with the clamping limb in the detent mode.
Figure 4:
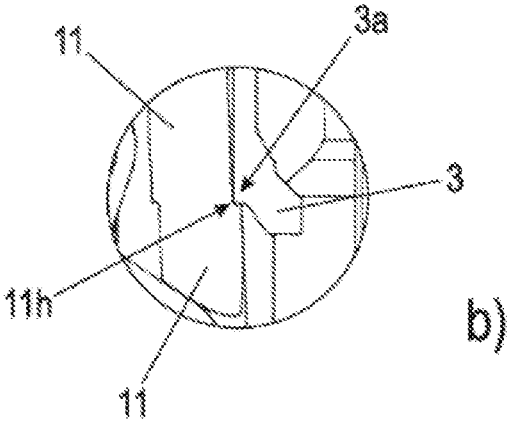
Figure 4:
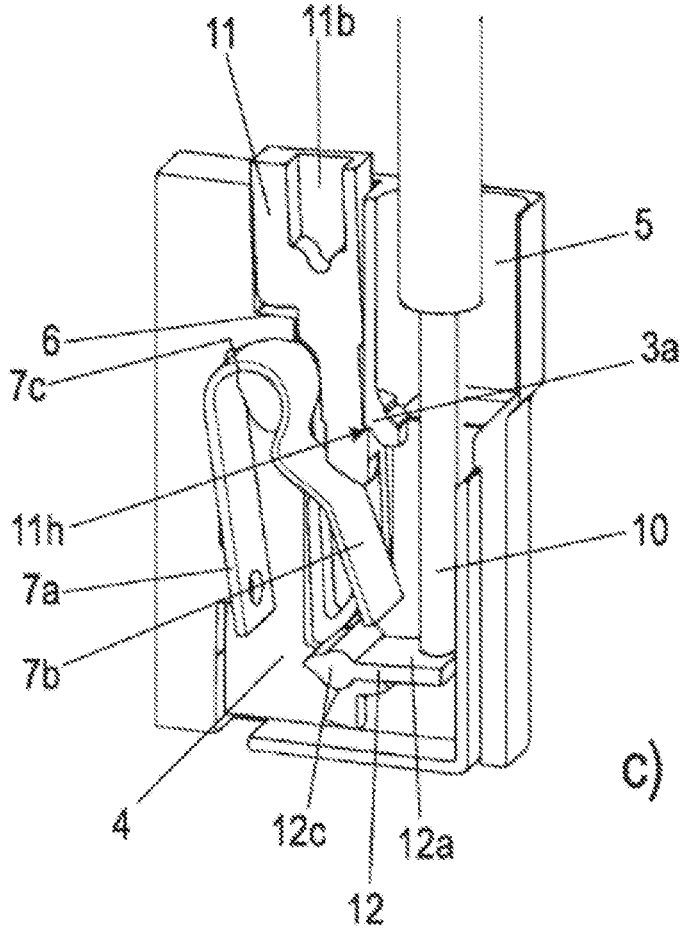

FIGS. 1*a* and 1*b* and FIGS. 2*a* and 2*b* show a first spring terminal 1. FIGS. 4*a* to 4*c* show another spring terminal 1 whose construction corresponds to the spring terminal 1 of FIGS. 1*a* to 1*c* and FIGS. 2*a* and 2*b* except for a slightly different geometry of a support contour 9 of the housing 3 which will be described below. The spring terminal 1 is shown in each case as a terminal which can be sequenced.

The spring terminal 1 includes a housing 3 in which a direct clamp connection 2 is formed. The housing 3 preferably includes an insulating plastic. A chamber 4 open on at least one side is formed in the housing 3. The chamber 4 includes a back wall. In addition, the chamber 4 is on the one hand connected by a conductor insertion conduit 5 to one of the outer sides of the housing—called the "insertion side", here the upper side and on the other hand by an actuating conduit 6. The actuating conduit 6 runs substantially parallel to the conductor insertion conduit 5. The actuating conduit 6 is formed in a stepped manner as shown in FIGS. 4*a* and 4*c*.

At least one clamping spring 7 and one bus bar 8 are arranged in the chamber 4 for forming the direct clamp connection 2. A clamping cage of metal can be provided which serves to support the clamping spring 7 and the bus bar 8. No clamping cage is provided in this embodiment where clamping is provided by walls of the chamber 4 of the housing 3.

The clamping spring 7 is U-shaped or V-shaped and includes a support limb 7*a* and a clamping limb 7*b*. The support limb 7*a* is supported on an abutment. This abutment is formed by a projection 3*b* on a wall of the chamber 4. The clamping limb 7*b* is connected to the support limb 7*a* by an arch-shaped back 7*c*. The back 7*c* extends over a support contour 9 of the housing 3 which projects into the chamber 4. This support contour 9 is cylindrical, by way of example and is constructed as shown in FIGS. 4*a* to 4*c* as a semi-cylinder in the direction of the back 7*c*. The support contour 9 also defines the pivot axis/axis of rotation located in the central axis of the cylinder contour for pivoting movement of the clamping limb 7*b*.

The pivotable clamping limb 7*b* acts on a conductor 10 with spring force in the area of a clamping position K to press the conductor 10 against the bus bar 8. This establishes an electrically conductive contact between the conductor 10 and the bus bar 8 as shown in FIG. 2*b*.

Figure 2A:
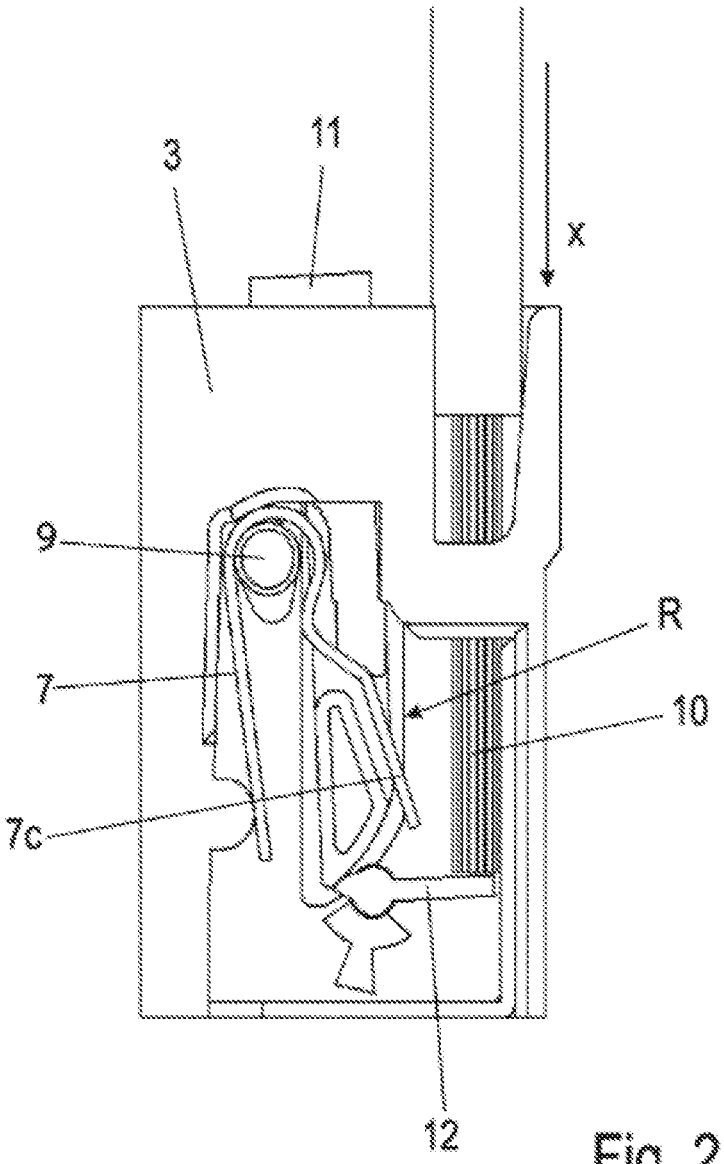
FIG. 2*a* is a side view of the spring terminal from FIG. 1*b* with a conductor during introduction of the conductor into the spring terminal, wherein the clamping limb is still in the detent mode.
Figure 2B:
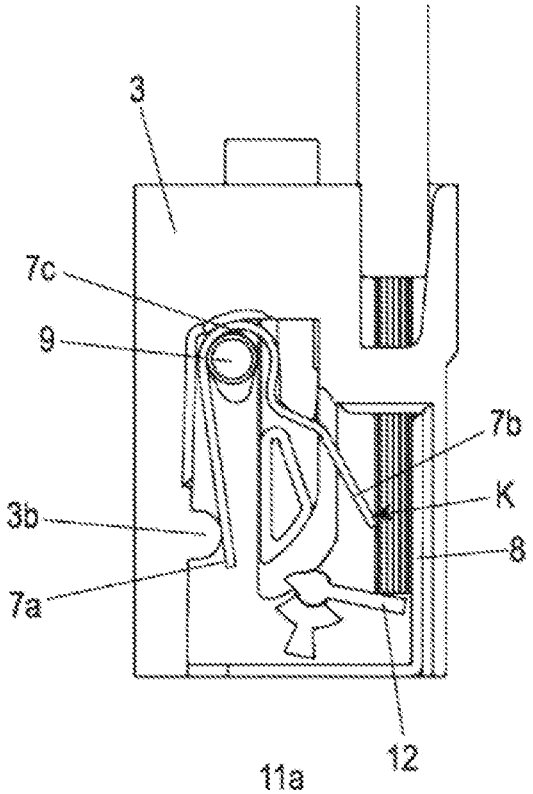
FIG. 2*b* is a side view of the spring terminal from FIG. 2*a* with an electrical conductor introduced into the spring terminal, wherein the clamping limb is released from the detent mode.
Figure 3:
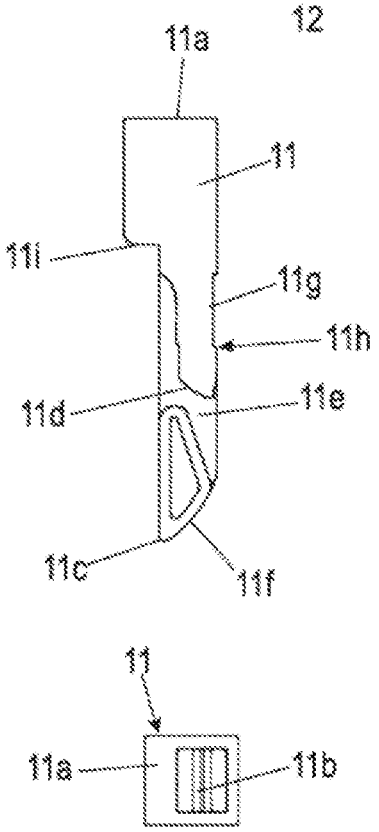
FIG. 3*a* is a side view of an actuating element of the spring terminal from FIGS. 1*a* and 2*a;*
FIG. 3*b* is a top view of the actuating element from FIG. 3*a;*

The conductor 10 can be extended in a conductor insertion direction X through the conductor insertion conduit 5 into the chamber 4 into the area of the clamping position K as shown in FIGS. 2*a* and 4*a*.

An actuating element is arranged in the actuating conduit 6. The actuating element is designed in a preferred embodiment as a pressure element, i.e. a latch 11 which is movably guided in the actuating conduit 6. A free end 11*a* of the latch 11 preferably projects outwardly over the outer side of the housing 3 so that it is readily accessible. However, this is not mandatory. Furthermore, an actuating contour—in particular a recess 11*b*—can be formed on this free end 11*a* for placing a tool, in particular a screwdriver, on the latch 11. This recess 11*b* is preferably dimensioned in such a manner that a screwdriver can be introduced relatively firmly and far into the recess 11*b* as shown in FIGS. 4*a* and 4*c*.

The other end 11*c* of the latch 11 projects into the chamber 4. The latch 11 furthermore includes a press contour lid—between its two ends 11*a* and 11*c*. This press contour lid serves to exert a force on the clamping limb 7*b* in the insertion direction by the latch 11 in order to open the clamping limb 7*b*.

The latch 11 includes a slot 11*e* such as a through opening with lateral walls below the first press contour lid. The clamping limb 7*b* extends through this slot 11*e*. The clamping limb 7*b* can pivot in a limited manner in the slot 11*e*.

Furthermore, the latch 11 includes an actuating contour 11*f*. This actuating contour 11*f* is provided under the slot 11*e* on the end 11*c*.

A movable release element 12 is arranged in the chamber 4 under the end 11*c* of the latch 11—underneath the actuating contour 11*f*. This release element 12 is preferably constructed as a tilting lever including two lever arms 12*a*, 12*b* which can rotate about an axis of rotation.

Furthermore, the latch 11 includes at least one lateral recess 11*g* on which a first undercut 11*h* is formed as also shown in FIG. 4*b*. This undercut 11*h* is a catch edge which cooperates with a corresponding catch edge 3*a* on/in the chamber 4 for the housing 3. This undercut 11*h* is formed on the side of the latch 11 which faces away from the clamping limb 7*b*.

Pressure can be exerted on the clamping limb 7*b* by pressing the latch 11 in the actuating opening 6 in the insertion direction X.

This serves on the one hand to open the clamping position K when the conductor has been introduced in order to be able to remove the conductor 10.

Starting from the position shown in FIG. 1*a*, however, the function of the latch 11 is at first a different one. As soon as the latch 11 or its undercut 11*h* has been pressed down so far that it passes the catch edge 3*a* in the transitional area from the actuating conduit 6 to the chamber 4, the latch 11 is pushed somewhat vertically to the insertion direction X for the conductor 10 to the side—for example, by the force of the clamping spring 7 or of the clamping limb 7*b*. At this time the undercut 11*h* catches behind the catch edge 3*a*. It is necessary that the latch 11 can move and pivot somewhat in the housing 3 and/or in the actuating conduit in a limited manner transversely to the insertion direction. This ability to pivot is preferably measured at least in such a manner that the undercut 11*h* can pivot into the previously described locked position as shown in FIGS. 4*a* and 4*c*.

In this manner the clamping spring 7 and its clamping limb 7*b* can be locked in an open position in the housing 3 as shown in FIGS. 1*b* and 2*a*. This locking takes place by pressure on the clamping limb in the direction of the introduction of the conductor by the latch 11, which is locked on the housing in a locked position from which it can be moved out. This principle is known, for example, in DE 10 2008 039 232 A1 or in WO 2015180950 A1.

In this position the conductor 10 can be readily pushed into the area of the clamping position K.

The release of the open position and of the locked position the clamping limb 7*b* is possible in two different ways.

Since the locked state does not take place by locking an element on the free clamping edge 7*d*, that is, the end of the clamping limb 7*b*, on which the conductor is to be clamped, only a very slight force is necessary to release the clamping limb out of the locked position. The spring terminal does not establish the catch position or the detent mode on the clamping edge of the clamping limb but rather by pressure on the clamping limb in the direction of the introduction of the conductor. In such a manner, even if the conductor 10 is constructed, for example, as a very thin multi-stranded conductor with which only a very slight force can be exerted on the release element 12, the latch 11 can be directly used for loosening the clamping spring 7 or its clamping limb 7*b* out of the catch position.

This can be achieved in different ways. The latch 11 is moved slightly in the housing 3 in such a manner for releasing the catch position—i.e. pushed or pivoted vertically laterally to the insertion position X—that the undercut 11*h* is moved out of the catch position on the catch edge 3*a* and locking of the latch 11 on the housing 3 is released. This also releases the catch position of the clamping limb 7*b*. In such a manner the clamping limb 7*b* of the clamping spring 7 can relax and press the conductor 10 in the clamping position K against the bus bar 8. This can be done manually or with a tool.

Alternatively, a force can be exerted on the release element 12 with the conductive end of the conductor 10 in the direction X of the introduction of the conductor in order to release the latch 11 from the open position and therefore out of the locked position. The conductor 10 presses on one of the two lever arms, namely, on the lever arm 12*a*. As a consequence, the release element rotates about its axis of rotation 12*c* and the other lever arm 12*b* acts on the actuating contour 11*f* of the latch 11. This action moves the latch 11, which is supported on the housing 3, in such a manner that it is released from the detent on the catch edge 6*a*, which frees the latch 11 and slides somewhat upward in the actuating conduit 6 again counter to the insertion direction X by the force of the freed clamping limb 7*b*.

This release of the catch position is the customary way for wiring the spring terminal 1. The previously described movement of the latch 11 is an alternative solution if, e.g., the conductor 10 is so flexible that no satisfactory force for actuating the release element 12 can be generated with it.

It is advantageous if the recess 11*b* on the end 11*a* of the latch 11, which end projects from the housing 4, is dimensioned to be so deep that a force can be exerted on the latch 11 with the inserted screwdriver or some other tool in order to release it from its locked position. This is shown in FIGS. 3*a*, 3*b* and 4*a* and 4*c*.

The latch 11 also includes a graduation 11*i* which corresponds to a graduation 6*a* of the actuation conduit and limits the insertion of the latch 11 in the direction X of the insertion of the conductor as shown in FIG. 4*a*.

Figure 5:
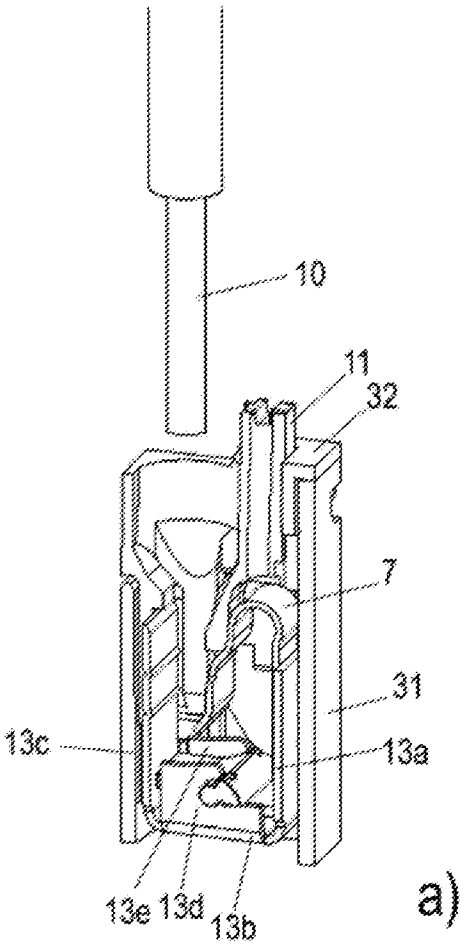
FIGS. 5*a* and 5*b* are side cutaways views of another spring terminal in a non-wired state and in a wired state, respectively.
Figure 5:
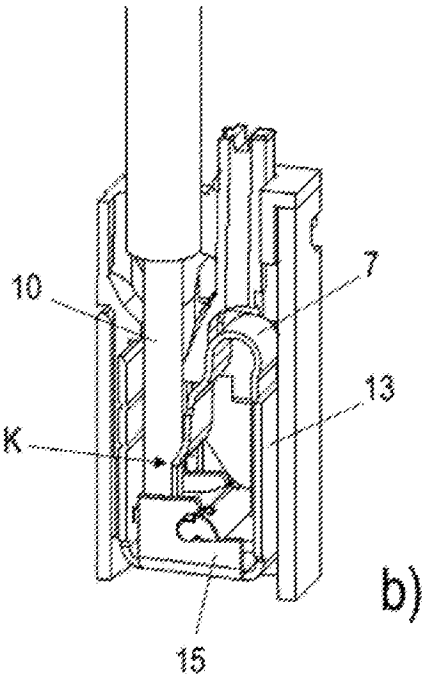

FIGS. 5 *a*, 5*b* and 6*a* show another spring terminal. This embodiment is shown in FIG. 5*a* in a non-wired state and in FIG. 5*b* in a state wired to a conductor 10, wherein in FIGS. 5*a* and 5*b* a part of the housing 30 of the spring terminal shown, however, in FIG. 6 was removed.

This housing 30 is designed somewhat differently than in the previous FIGS. 1 to 4. There, the housing 3 was shown open on one side so that in this manner the clamping spring 7 and other structural elements can be mounted from the open side in the housing 3. The clamping spring 7 is supported in plastic.

Figure 6:
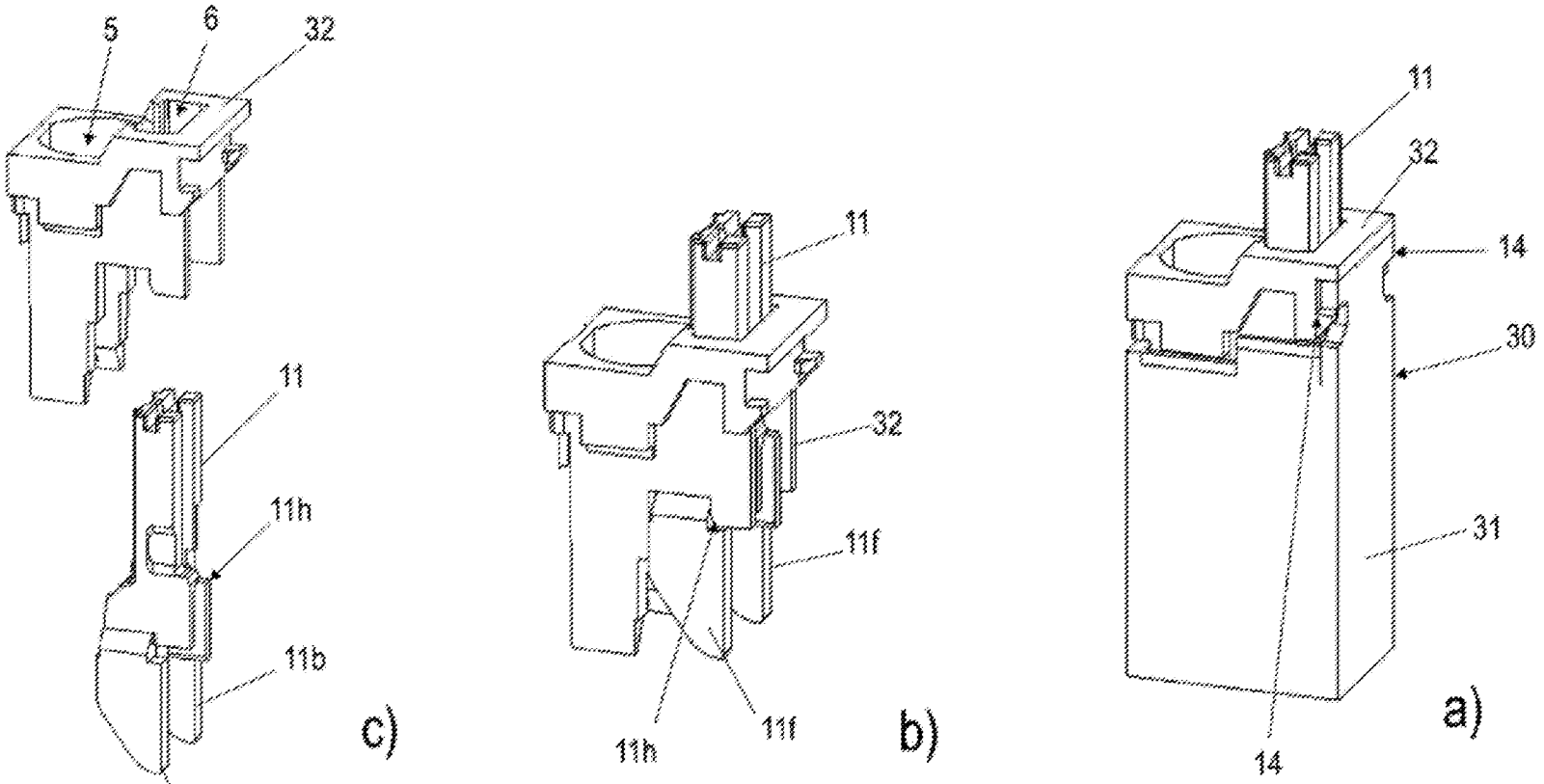
FIG. 6*a* is a perspective view of the spring terminal from FIG. 5.
FIGS. 6*b* and 6*c* are perspective views of structural elements and/or of structural groups of the spring terminal from FIG. 6*a*, respectively.

On the other hand, according to FIGS. 5 and 6 a multi-part housing 30 is provided which includes a lower housing part 31 and an upper housing part 32 which can be set on the latter. The lower housing part 31 is designed as a casing which is circumferentially closed in cross section, is rectangular and is open on one or two opposing front sides upward and downward.

Figure 7:
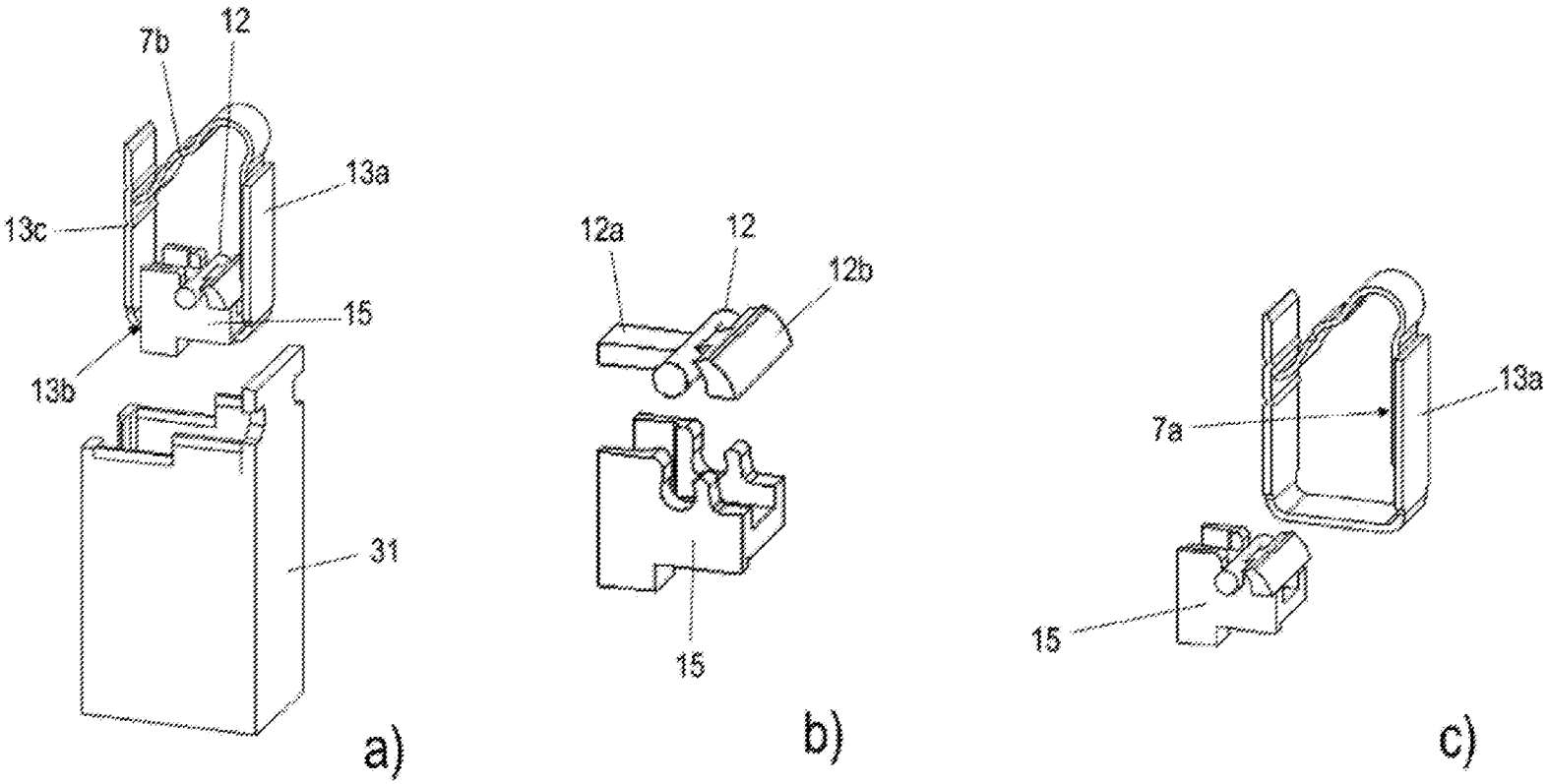
FIGS. 7*a*-7*c* are perspective views of variations of individual structural elements and/or structural groups for the spring terminal from FIG. 6*a;*

Furthermore, according to FIGS. 5 to 7 a metallic structure is provided which includes a clamping cage 13 shown in FIGS. 7*a* and 7*c* into which the clamping spring 7 can be set. Therefore, direct support of the clamping spring 7 on the support limb 7*a* in the housing 30 is not provided here. The clamping cage 13 is at least U-shaped in a side view and includes three limbs 13*a*, 13*b*, and 13*c*. It is open on the side, which, however, is not a problem since the bottom housing part 31 centers the conductor 10.

The clamping spring 7 is set between these limbs 13*a*, 13*b*, 13*c*. At least one of the limbs 13*a*, 13*b*, 13*c* can be used for the connection to an electrical structural group (not shown), for example, for the connection to a plug, or to a printed circuit board or the like. This applies in an analogous manner to the bus bar 8 of FIGS. 1 to 4.

Figure 1:
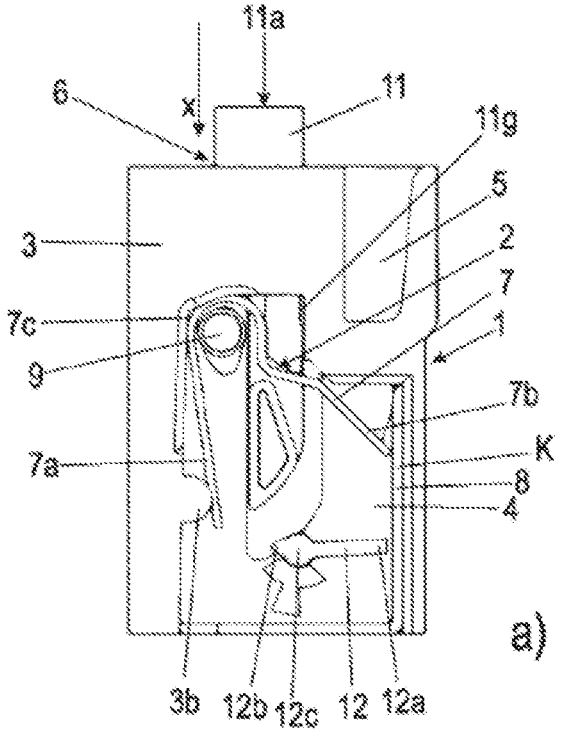
FIG. 1*a* is a side view of a spring terminal with a clamping limb which is provided for clamping an electrical conductor which is introduced or can be introduced into the spring terminal in a non-detent mode.
FIG. 1*b* is a side view of the spring terminal from FIG. 1*a* with the clamping limb in a detent mode.
Figure 1:
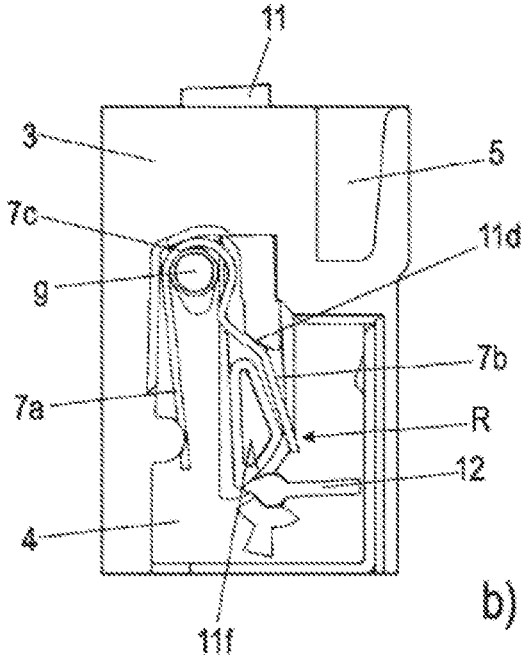

In contrast thereto, the bus bar 8 in FIG. 1 is, for example, L-shaped in the side view. This L is supplemented b) another limb 13*a* so that a support limb 13*a* is formed. The support limb 13*a* serves to support the support limb 7*a* of the clamping spring 7 (which limb 7*a* is adhered, for example, to the limb 13*a*), whose clamping limb 7*b* of the clamping spring 7 presses a conductor 10 in the wired state of FIG. 5*b* for making contact against the limb 13*c*, which also has a current-conducting function and/or bus bar function and/or assumes the function of the bus bar.

The clamping cage 13 can be set with the clamping spring 7 from an open side into the bottom housing part 31. In this manner, these elements can be preassembled to one another so that they can be readily further assembled and lie well-protected in the bottom housing part 31.

The upper housing part 32 and the bottom housing part 31 can preferably be locked to one another on a corresponding locking device 14 after the clamping cage 13 and the clamping spring 7 have been assembled together as shown in FIG. 7*a*.

The conductor insertion conduit 5 and the actuating conduit 6 for the latch 11 are formed in the upper housing part 32. For its part, this latch can be locked in housing 30 in such a manner that an open position is formed in which the clamping position K can be opened and a conductor 10 can be introduced into this clamping position K as described above in connection with FIGS. 1 to 4.

In order to release this catch position, a release element 12 is provided. According to FIG. 5 this release element 12 is formed from a substructure group of the structural group of the elements 13 and 7. This substructure group can be, purely of metal, purely of plastic or mixed from elements of metal and of plastic. It includes the release element 12 and a bearing block 15 on which the release element 12 is pivotably supported. This substructure group can be preassembled on the clamping cage 13 and inserted together with the latter and the bus bar 7 into the housing 30.

According to FIGS. 5*a* and 5*b*, two short metallic limbs 13*d*, 13*e* are upwardly bent against the conductor insertion direction X from the limb 13*b* of the clamping cage and which form the bearing block 15 for the release element 12 in the manner of a rocker which can be formed of plastic or metal and is pivotably supported on the bearing block 15 at corresponding receptacles.

The bearing block 15 can also be designed as an element of metal or plastic which is separate from the clamping cage 13 and which can be fastened on the clamping cage 13 as shown in FIGS. 7*a*-7*c* and includes receptacles for the release element 12. This is the difference of the embodiment of FIG. 7 from the embodiment of 5 and 6.

The release element 12 includes two lever arms 12*a*, 12*b*. Therefore, a force can be exerted on the release element 12 by the conductor end of the conductor 10 in the direction X of the introduction of the conductor in order to release the latch 11 out of the open position and therefore out of the locked position. The conductor 10 presses on one of the two lever arms, namely the lever arm 12*a*. As a result, the release element 12 rotates about its axis of rotation 12*c* and the other lever arm 12*b* acts as a release contour on one or two corresponding actuating contour(s) 11*f* of the latch 11. These arms are designed as arms which extend laterally from the clamping cage. In this manner a reliable release can be realized in two arms of the latch 11. This effect also moves the latch 11, which is supported on the housing 3 in a locked manner so that it is released from the lock on the catch edge 6*a*, as a result of which the latch 11 is released and slides somewhat upwards in the actuation conduit 6 again counter to the insertion direction X by the force of the released clamping limb 7*b*.

The clamping limb 7*b* then presses the conductor end of the conductor 10 against the limb 13*a*.

Alternatively, the latch 11 can be directly released from the locked position, as described above.

FIGS. 8*a* to 9*c* show another embodiment of a spring terminal. This embodiment corresponds substantially to the spring terminal as described above in connection with FIGS. 5*a* to 7*c*.

Figure 8A:
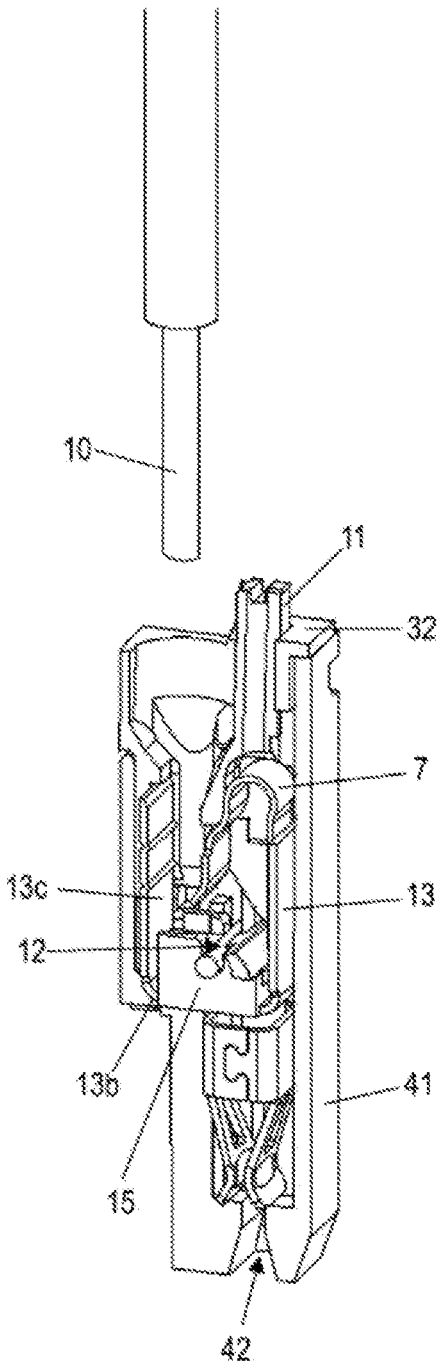
FIGS. 8*a*-8*b* are side perspective cutaway views of another spring terminal in an unwired state and in a wired state, respectively.
Figure 8B:
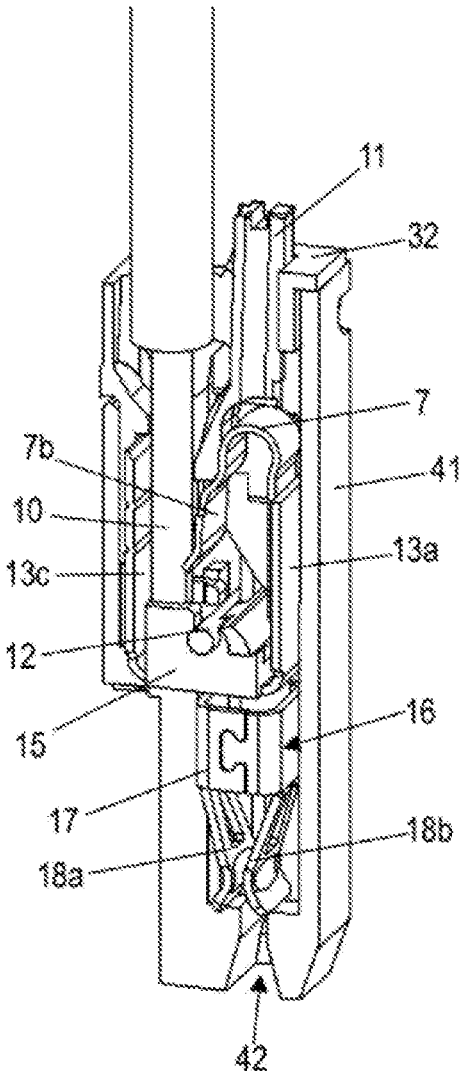
Figure 8C:
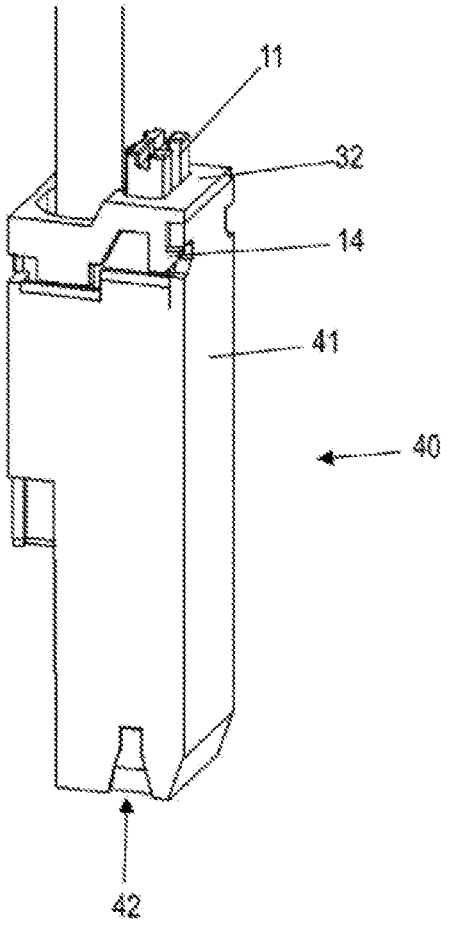
FIG. 8*c* is a perspective view of the spring terminal from FIGS. 8*a* and 8*b;*

As is shown in FIGS. 8*a* to 8*c*, the spring terminal also has a multi-part housing 40 with the bottom housing part 41 and an upper housing part 32 which can be set on the latter one. The upper housing part 32 corresponds to the upper housing part 32 described in connection with FIGS. 5*a* to 7*c*.

The bottom housing part 41 is constructed in a lengthened manner compared to the bottom housing part 31 described above and includes a receptacle 42 on its lower end for receiving an electrical contact, for example, a so-called knife contact, which is provided on sheet bars.

A connection 16 is received in the hollow space of the extended bottom housing part 41.

Figure 9:
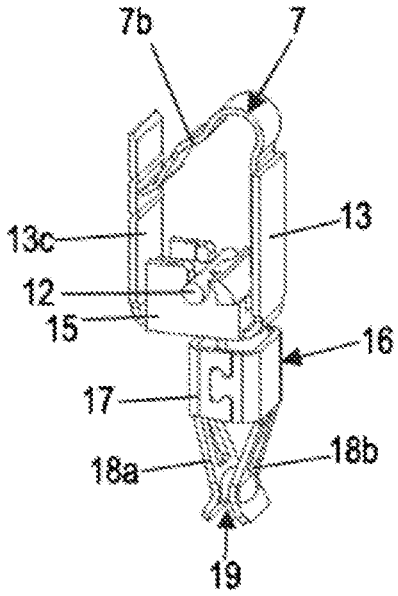
FIGS. 9*a*-9*c* are perspective views of structural elements and/or of structural groups, respectively, of the spring terminal from FIG. 8*c;*
Figure 9:
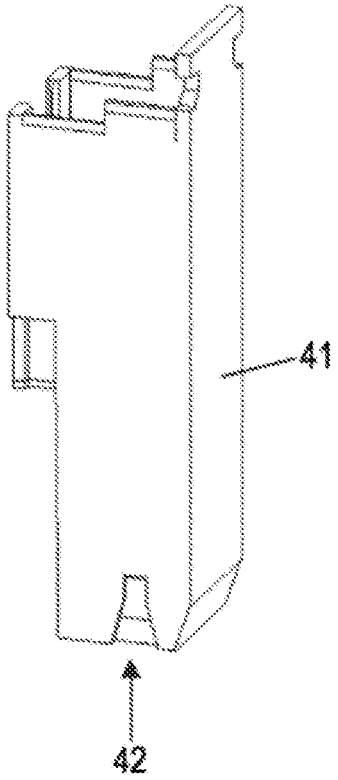
Figure 9C:
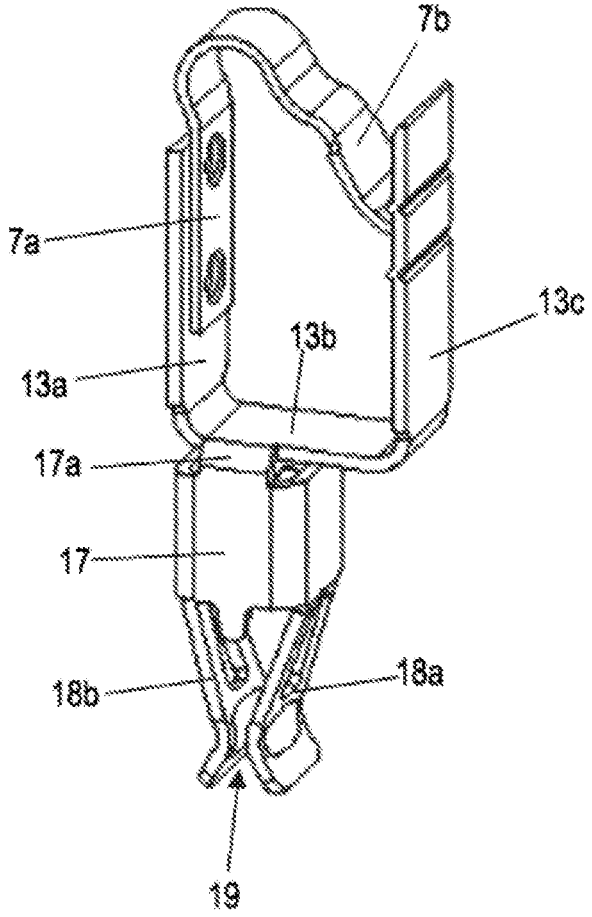

The connection 16 is connected to the clamping cage 13 as shown in FIG. 9*c* and therefore serves as the connection to an electrical structural group (not shown).

The connection 16 includes an intermediate part 17 which is connected via a limb 17*a* to the limb 13*b* of the clamping cage 13.

Two clamping limbs 18*a*, 18*b* extend on an end of the intermediate part 17 facing away from the clamping cage 13, which are bent away from side edges of the intermediate part 17 approximately in a V-shape running toward one another until they contact one another, wherein the free ends are bent running away from one another in order to form a receptacle 19 so that, for example, a knife contact can be inserted through the receptacle 42 of the bottom housing part 41 and the receptacle 19 between the clamping limbs 18*a*, 18*b*, which establishes an electrical contact between the knife contact (not shown) and the clamping cage 13.

It is also conceivable to geometrically adapt the receptacle 42 of the bottom housing part 41 and the connection 16, which is electrically connected to the clamping cage 13, to a wire conductor or another design of a plug contact.

FIGS. 10*a* to 13 show another possible—and advantageous—embodiment of a spring terminal. They show another spring terminal 1 whose construction and function largely correspond to that of the spring terminal 1 of FIGS. 1*a*-1*c*, 2*a*-2*b* and 3.

To this extent, the description for those figures also applies to these figures.

According to FIGS. 10*a* to 13, the embodiment described above is obtained in that the free end 11*a* of the latch 11 does not project outwardly over the outside of the housing 3. Rather, it is located inside the actuation conduit 6. This applies in particular to the detent state R and the tensioned, locked state of the clamping spring 7. This can also apply to both states, the tensioned, locked decent state or the non-tensioned, non-locked state. Then, no additional space is required for the latch 11 since it does not project out of the actuating opening 6. In addition, it is located in a well-protected manner in the latter.

Furthermore, at least one actuating contour—in particular a recess 11*b* can advantageously again be formed on this free end 11*a* for placing a tool, in particular a screwdriver, on the latch 11. This recess 11*b* or one of the recesses is again preferably dimensioned in such a manner that a screwdriver can be introduced into the recess 11*b* FIGS. 4*a* and 4*c*. This recess 11*b* is formed by a lateral shoulder on the latch 11. The contour recess refers to the end 11*a* and insertion of this end in the insertion direction X.

The latch 11 includes a side catch edge 11*h* which can be locked by moving vertically to the insertion direction X behind the catch edge 3*a* in the detent mode R and can be released by oppositely moving transversely or vertically to the insertion direction X out of the detent mode R.

Figure 13:
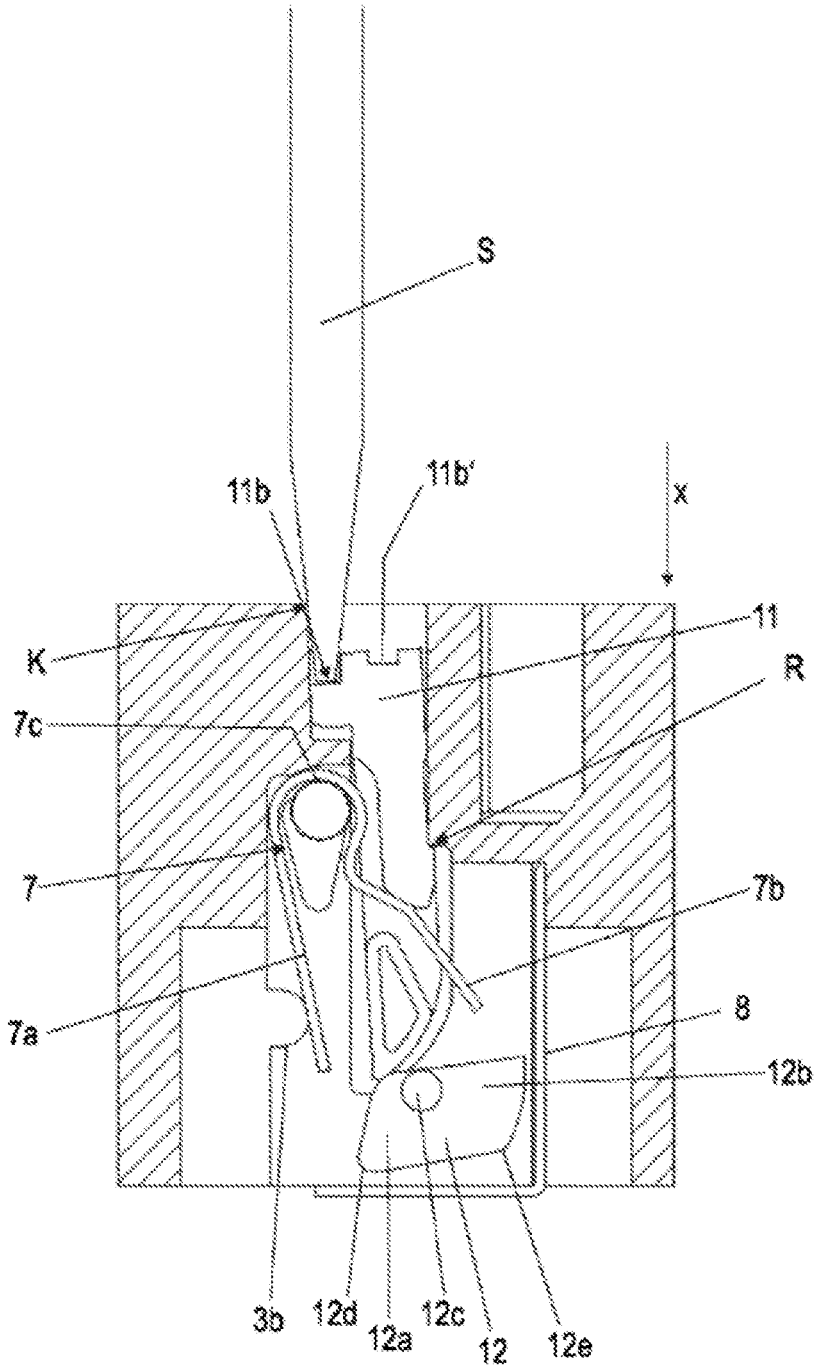
FIG. 13 is a side sectional view of the spring terminal from FIG. 10*a* in the detent mode from FIG. 12 without a conductor introduced into the clamping position and with an actuating tool placed at another position of the latch relative to FIG. 11 with which the detent mode should be released.

The latch 11 is moved during moving in the insertion direction X by the spring force of the clamping spring 7 transversely to the insertion direction into the catch position and the latch 11 can be released out of the detent mode R by moving with a manually actuatable actuating tool such as a screwdriver S in the opposite direction as shown in FIG. 13. This takes place by rotating the latch 11. To this end, the latch 11 again includes at least one recess 11*b* for placing an actuating tool on it and which is dimensioned in such a manner that movement of the latch in the insertion direction X and also pivoting vertically to the insertion direction X can be realized with the actuating tool—here the screwdriver.

Figure 11:
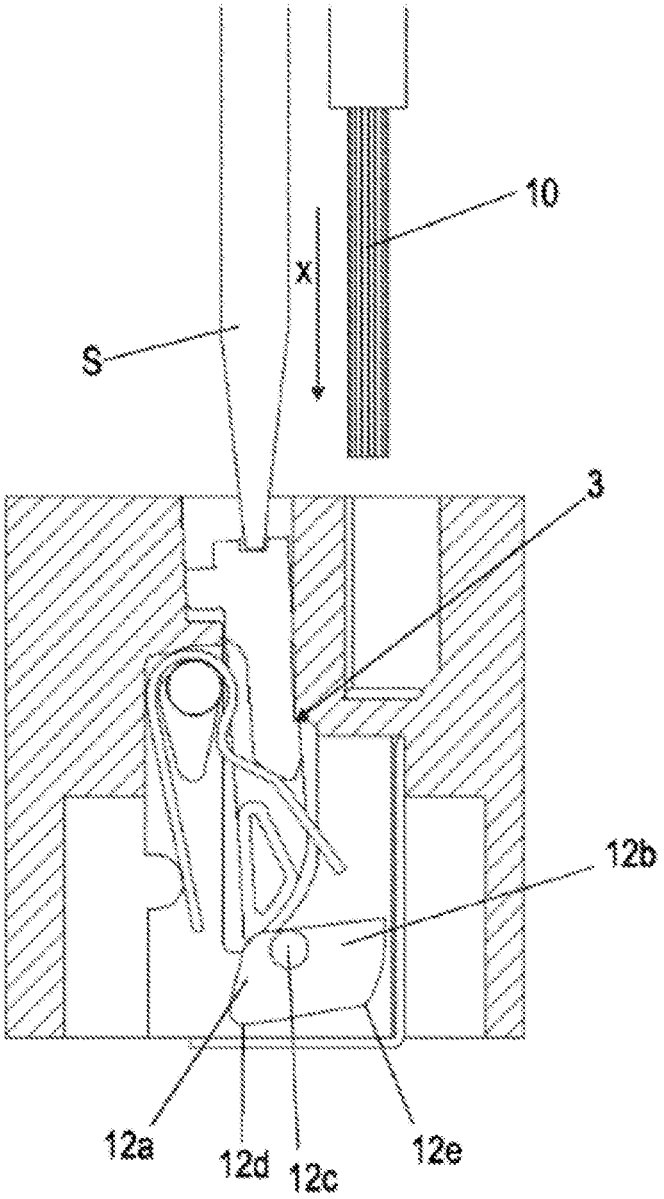
FIG. 11 is a lateral sectional view of the spring terminal from FIG. 10*a* with an actuating tool set on it in a state in which the clamping limb of a clamping spring is placed in a detent mode and in which a conductor can then be introduced into a clamping position.
Figure 12:
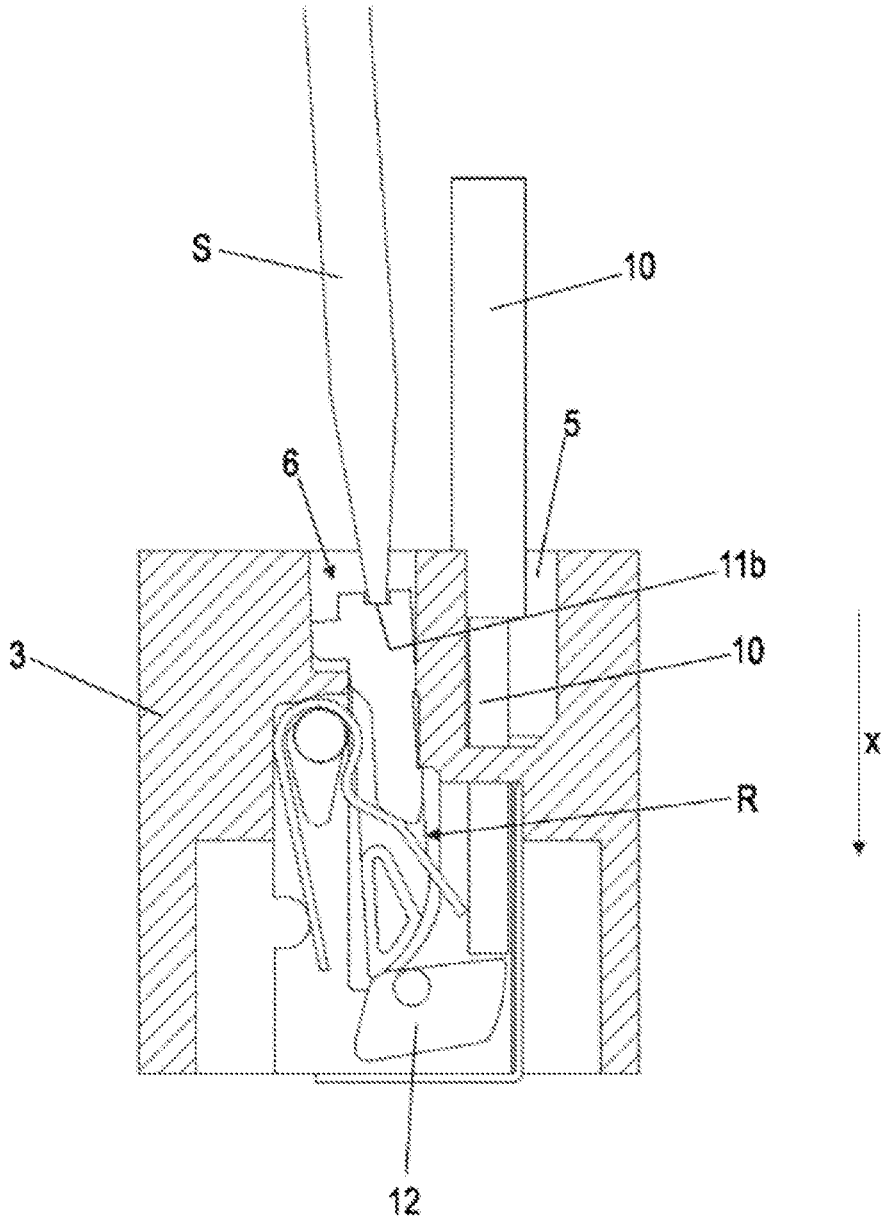
FIG. 12 is a side sectional view of the spring terminal from FIG. 10*a* in the detent mode with a conductor introduced into the clamping position and with an actuating tool.

This recess 11*b* is preferably formed on the side of the latch 11 on the end 11*a*. The screwdriver S can then engage with its end into this recess 11*b* and rest on an edge K on the end of the actuating opening 6 on the housing 3 so that a defined pivoting is possible as shown in FIG. 13 so that the screwdriver rotates about the edge as an axis of rotation. The latch 11 is released out of the catch and the entire detent mode is released as shown in FIGS. 11 and 13.

Another central recess 11*b*' can be provided which affords pressing of the latch 11 parallel to, or in the insertion direction 11. The latch 11 can then include two of the recesses 11*b*, 11*b*. This affords simple construction and facilitates handling. Otherwise, the function and the handling of this embodiment correspond to that of FIGS. 1*a*, 1*b*, 2*a*, and 2*b*.

Therefore, the latch 11 includes two recesses 11*b*, 11*b*' for the actuation tool. The recesses are dimensioned in such a manner so that movement of the latch in the insertion direction X as well as vertically to the insertion direction X can be realized with the actuating tool with these two recesses 11*b*, 11*b*'.

It should also be mentioned that one or two stop devices is/are provided on the rocker-like release element 12. To this end, the rocker or the tilting lever as the release element are designed so that during rotation, one or both of its lever arms 12*a*, 12*b* can strike against an abutment, e.g., a section of the bus bar 8 or against a housing edge or the like. In this manner, one or two geometric end stops 12*d*, 12*e* can be provided as the stop devices one or both of which provide the following functions protection against rotating the release element 12 too far or the tilting lever too tar during tensioning or production of the detent mode and against rotating the release element 12 too far during release by the conductor 10.

Figure 14:
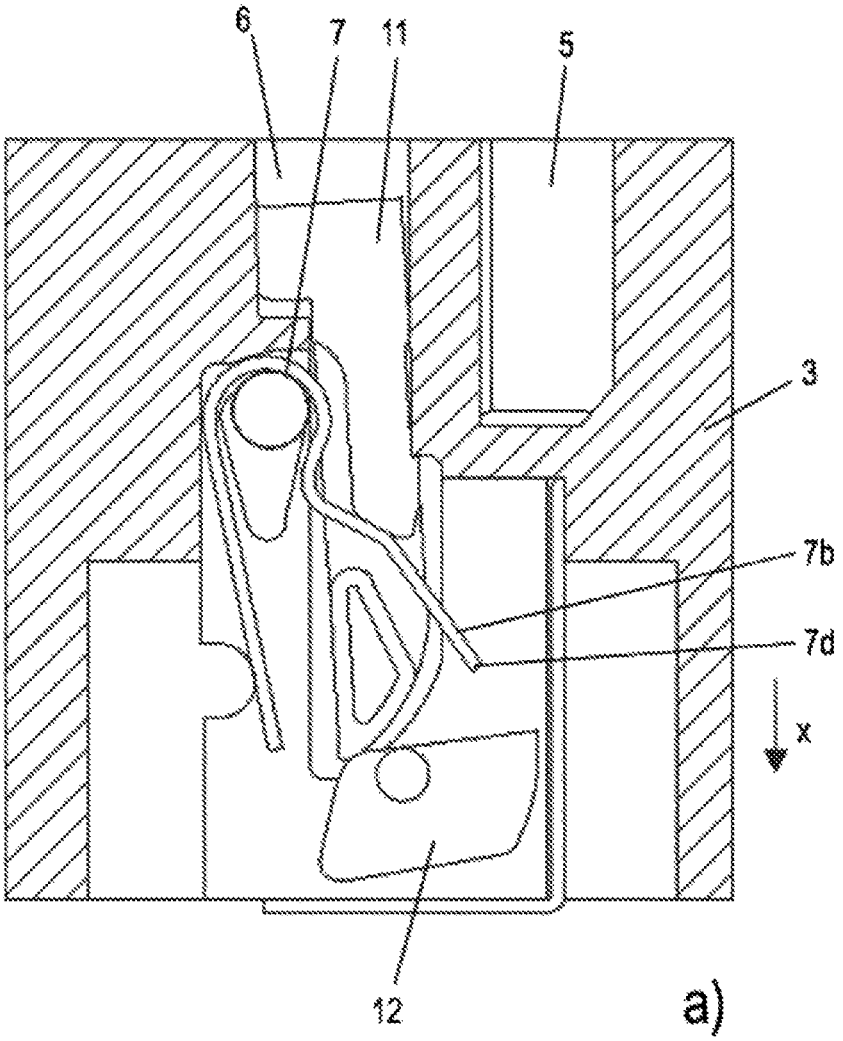
FIGS. 14*a* and 14*b* are side sectional views of another spring terminal in an open detent mode and an actuating element of the spring terminal from FIG. 10*a*, respectively, which actuating element is constructed as a latch.
Figure 14:
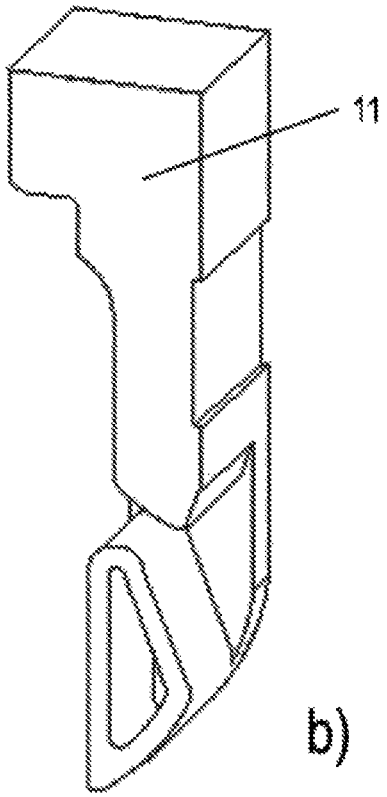

FIGS. 14*a* and 14*b* show another embodiment of a spring terminal according to the invention. They show another spring terminal 1 whose construction and function largely correspond to that of the spring terminal 1 of FIGS. 1*a*-1*c*, 2*a* and 2*b*. To this extent, the description for those figures also applies to these figures.

In the embodiment of FIGS. 14*a* and 14*b*, the free end 11*a* of the latch 11 does not project outwardly over the outer side of the housing 3. Rather, it is located inside the actuating conduit 6. This applies in particular to the detent mode R and to the tensioned, locked state of the clamping spring 7. This can also apply to both states, the tensioned, locked detent mode or to the non-tensioned, non-locked state. No additional construction space is required for the latch 11 since it does not project out of the actuating opening 6. In addition it is well protected in the latter.

The latch 11 can again exert pressure on the clamping limb 7*b* in the direction X of the introduction of the conductor by being pressed into the actuating conduit 6 and locking on the housing 3 in the detent mode can be brought about in which the clamping limb is pivoted in such a manner that a conductor can be introduced into the provided position.

Figure 10B:
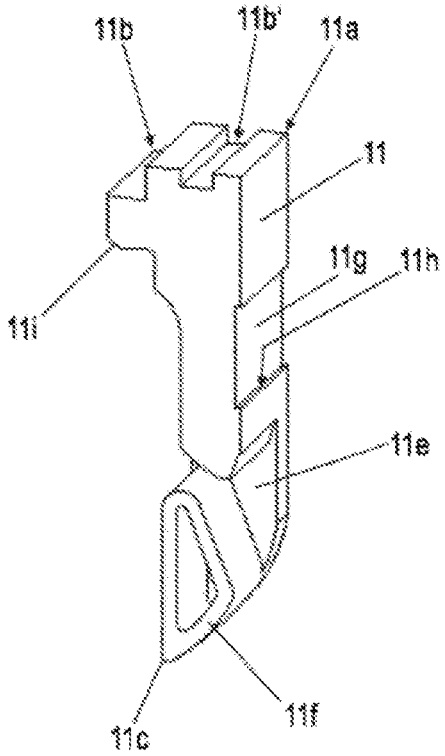
FIG. 10*b* is a perspective view of an actuating element of the spring terminal from FIG. 10*a* constructed as a latch.
Figure 10A:
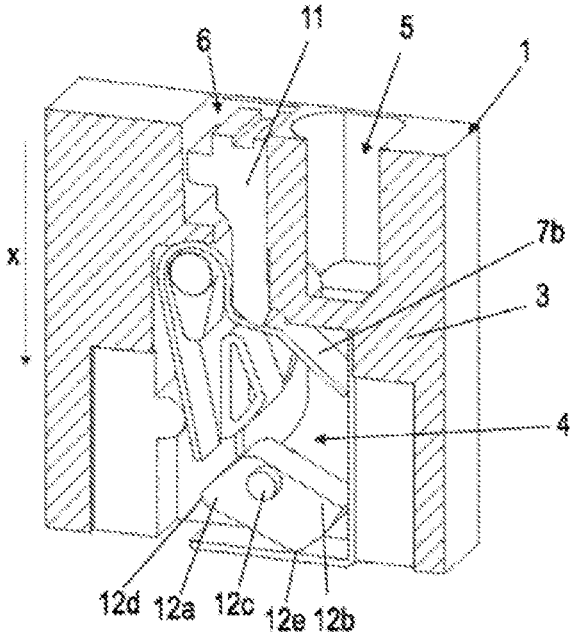
FIG. 10*a* is a perspective sectional view of another spring terminal with a clamping limb which is provided for clamping an electrical conductor introduced or which can be introduced into the spring terminal in a non-locked, non-open state of a clamping spring.

As distinguished from the embodiment shown in FIGS. 10 and 11, the latch 11 is located in such a manner that the detent mode can be produced but cannot be released again by a screwdriver by tilting. Therefore, the latch is eliminated as an adjustment device.

The detent mode is produced by pressure on the clamping limb 7*b* in the direction of the introduction of the conductor. The detent mode R is not produced by locking an element on the free clamping edge 7*d* of the clamping limb and can be released by introducing the conductor in the direction X of the introduction of the conductor into the housing 3.

Therefore, only one adjustment device is provided. It is the only adjustment device. It includes a movable release element 12 onto which the end of the conductor 11 to be contacted acts during the release of the conductor 11 and with which the clamping limb 7*b* of the clamping spring 7 can be released out of the detent mode directly or indirectly by acting on the latch 11.

While the preferred forms and embodiments of the invention have been illustrated and described, it will be apparent to those of ordinary skill in the art that various changes and modifications may be made without deviating from the inventive concepts set forth above.

The invention claimed is:

1. A direct clamp terminal for connecting an electrical conductor, comprising:

a) a housing containing a chamber and an insertion conduit which permits the electrical conductor to be inserted into the chamber;

b) a bus bar connected with said housing;

c) a clamping spring arranged in said chamber and providing a pressure force to connect the electrical conductor with the bus bar in a clamping position, said clamping spring including a clamping limb which pivots about a pivot axis for movement between a detent mode in which it is locked in a locked position and a clamping mode in which it is released from the detent mode and presses the electrical conductor against said bus bar;

d) an actuating element movable within said housing to release said clamping limb from the detent mode and move said clamping limb to the clamping mode; and e) a release element connected with said housing for operating said actuating element to release said clamping limb from the detent mode, said actuating element alternatively being manually operable to release said clamping limb from the detent mode.

2. A direct clamp terminal as defined in claim 1, wherein said clamping limb includes a free terminal edge which presses against the electrical conductor after insertion of the electrical conductor into said chamber and operation of said release element and said actuating element.

3. A direct clamp terminal as defined in claim 1, wherein the detent mode is established by pressure on the clamping limb in the direction of introduction of the electrical conductor.

4. A direct clamp terminal as defined in claim 2, wherein said release element is engaged by an end of the electrical conductor to release said clamping limb from the detent mode.

5. A direct clamp terminal as defined in claim 4, wherein said actuating element is locked in the detent mode with said clamping limb and is released from the detent mode with said clamping limb.

6. A direct clamp terminal as defined in claim 1, wherein said housing includes a locking edge and contains an actuating conduit and wherein said actuating element comprises a latch for moving said clamping limb within said actuating conduit in an insertion direction and which can be locked on said housing locking edge in the detent mode.

7. A direct clamp terminal as defined in claim 6, wherein said latch includes a lateral catch edge which is locked in the detent mode by moving vertically in the insertion direction behind said housing locking edge and can be released by opposite movement out of the detent mode.

8. A direct clamp terminal as defined in claim 7, wherein said actuating conduit extends parallel to said electrical conductor insertion conduit.

9. A direct clamp terminal as defined in claim 7, wherein said latch includes a free end which extends out of said actuating conduit in the detent mode.

10. A direct clamp terminal as defined in claim 7, wherein said latch includes a free end which is arranged in said housing in the detent mode.

11. A direct clamp terminal as defined in claim 7, wherein said latch is moved into the locked position by the spring force of said clamping spring in a direction transverse to the insertion direction.

12. A direct clamp terminal as defined in claim 11, wherein said latch is released from the detent mode in an opposite direction transverse to the insertion direction by operation of a manual actuating tool.

13. A direct clamp terminal as defined in claim 11, wherein said latch is released from the detent mode by pressure of the electrical conductor on said release element in the insertion direction of the electrical conductor.

14. A direct clamp terminal as defined in claim 11, wherein said latch includes at least one recess for receiving said actuating tool, whereby movement of said latch in the insertion direction and also vertically to the insertion direction is provided by the actuating tool.

15. A direct clamp terminal as defined in claim 4, wherein said release element comprises a tilting lever pivotably connected with said housing.

16. A direct clamp terminal as defined in claim 4, wherein said release element releases said latch from the catch position.

17. A direct clamp terminal as defined in claim 4, wherein said release element is integral with said latch.

18. A direct clamp terminal as defined in claim 15, wherein said tilting lever comprises two lever arms, one of said lever arms pivoting with the electrical conductor, another of said lever arms acting on said latch to release said latch from the detent mode.

19. A direct clamp terminal as defined in claim 1, wherein said housing comprises a bottom housing part and an upper housing part fastened to said bottom housing part.

20. A direct clamp terminal as defined in claim 19, wherein said bottom housing part comprises a circumferentially closed casing which is open on at least one side.

21. A direct clamp terminal as defined in claim 19, wherein said electrical conductor insertion conduit and said actuating conduit area are arranged in said upper housing part.

22. A direct clamp terminal as defined in claim 20, and further comprising a clamping cage connected with said housing, said clamping cage receiving said clamping spring, said clamping cage and said clamping spring being inserted from an open front side into said bottom housing part.

23. A direct clamp terminal as defined in claim 21, wherein said clamping cage includes a bearing block which pivotably supports said release element.

24. A direct clamp terminal as defined in claim 2, wherein said clamping cage, said clamping spring, said bearing block, and said release element are formed as a unit which can be preassembled and inserted into said bottom housing part.

25. A direct clamp terminal as defined in claim 23, wherein said release element includes at least one stop to prevent excess rotation toward the detent mode and during the release of the electrical conductor.

* * * * *